US007613588B2

(12) United States Patent
Katsu et al.

(10) Patent No.: US 7,613,588 B2
(45) Date of Patent: Nov. 3, 2009

(54) SHOE SHAPE SELECTION METHOD, SHOE SHAPE SELECTION SYSTEM AND SHOE TIP SHAPE SELECTION METHOD

(75) Inventors: Makoto Katsu, Kobe (JP); Tetsuro Kurashina, Kobe (JP); Hiroyuki Kusumi, Kobe (JP)

(73) Assignee: ASICS Corporation, Kobe (JP)

( * ) Notice: Subject to any disclaimer, the term of this patent is extended or adjusted under 35 U.S.C. 154(b) by 26 days.

(21) Appl. No.: 10/552,692

(22) PCT Filed: Apr. 9, 2004

(86) PCT No.: PCT/JP2004/005169

§ 371 (c)(1),
(2), (4) Date: Jun. 7, 2006

(87) PCT Pub. No.: WO2004/091332

PCT Pub. Date: Oct. 28, 2004

(65) Prior Publication Data

US 2006/0282231 A1 Dec. 14, 2006

(30) Foreign Application Priority Data

Apr. 16, 2003 (JP) ..... 2003-111188

(51) Int. Cl.
*G01B 7/00* (2006.01)
*A43B 3/26* (2006.01)
*G06Q 30/00* (2006.01)

(52) U.S. Cl. ..... 702/155; 36/97; 705/26

(58) Field of Classification Search ..... 702/127, 702/155, 182; 36/97; 705/26
See application file for complete search history.

(56) References Cited

U.S. PATENT DOCUMENTS 5,671,055 A * 9/1997 Whittlesey et al. ..... 356/602
6,735,547 B1 * 5/2004 Yfantis ..... 702/155
6,823,550 B2 * 11/2004 Kantro ..... 12/142 N
7,236,948 B1 * 6/2007 Mochimaru et al. ..... 705/26

FOREIGN PATENT DOCUMENTS

JP 2000-152804 6/2000
JP 2000-354503 12/2000

* cited by examiner

*Primary Examiner*—Bryan Bui
(74) *Attorney, Agent, or Firm*—Michael E. Zall

(57) ABSTRACT

A shoe shape selection method selects an appropriate shoe shape from a plurality of kinds of shoe shapes prepared beforehand, based on a plurality of items of data on a customer. The plurality of data items include the foot length of the customer, the foot girth of the customer and the difference between the lengths of the first and second toes of the customer.

10 Claims, 10 Drawing Sheets

THE RELATIONSHIP BETWEEN A, B, C IS REPRESENTED BY A < B < C

THE RELATIONSHIP BETWEEN A, B, C IS REPRESENTED BY A < B < C

Fig. 8

| | D | E | F | G | H |
|---|---|---|---|---|---|
| INDEX OF SATISFACTION | 72 | 66 | 44 | 41 | 55 |
| NUMBER OF TEST-FITTED SHOES | 82 | 82 | 55 | 55 | 82 |
| PERCENTAGE OF SATISFACTION (%) | 87.8 | 80.5 | 80.0 | 74.5 | 67.1 |

D: CORRESPONDING TO FIG. 2

E: CORRESPONDING TO FIG. 3(a)

F: CORRESPONDING TO FIG. 3(b)

G: CORRESPONDING TO FIG. 3(c)

H: CORRESPONDING TO FIG. 9

Fig.10

| UNIT cm | WIDTH FOR MEN (width)mm | | | | | | | | | |
|---|---|---|---|---|---|---|---|---|---|---|
| SIZE | A | B | C | D | E | EE | EEE | EEEE | F | G |
| 20.5 | 189 | 195 | 201 | 207 | 213 | 219 | 225 | 231 | 237 | 243 |
| 21.0 | 192 | 198 | 204 | 210 | 216 | 222 | 228 | 234 | 240 | 246 |
| 21.5 | 195 | 201 | 207 | 213 | 219 | 225 | 231 | 237 | 243 | 249 |
| 22.0 | 198 | 204 | 210 | 216 | 222 | 228 | 234 | 240 | 246 | 252 |
| 22.5 | 201 | 207 | 213 | 219 | 225 | 231 | 237 | 243 | 249 | 255 |
| 23.0 | 204 | 210 | 216 | 222 | 228 | 234 | 240 | 246 | 252 | 258 |
| 23.5 | 207 | 213 | 219 | 225 | 231 | 237 | 243 | 249 | 255 | 261 |
| 24.0 | 210 | 216 | 222 | 228 | 234 | 240 | 246 | 252 | 258 | 264 |
| 24.5 | 213 | 219 | 225 | 231 | 237 | 243 | 249 | 255 | 261 | 267 |
| 25.0 | 216 | 222 | 228 | 234 | 240 | 246 | 252 | 258 | 264 | 270 |
| 25.5 | 219 | 225 | 231 | 237 | 243 | 249 | 255 | 261 | 267 | 273 |
| 26.0 | 222 | 228 | 234 | 240 | 246 | 252 | 258 | 264 | 270 | 276 |
| 26.5 | 225 | 231 | 237 | 243 | 249 | 255 | 261 | 267 | 273 | 279 |
| 27.0 | 228 | 234 | 240 | 246 | 252 | 258 | 264 | 270 | 276 | 282 |
| 27.5 | 231 | 237 | 243 | 249 | 255 | 261 | 267 | 273 | 279 | 285 |
| 28.0 | 234 | 240 | 246 | 252 | 258 | 264 | 270 | 276 | 282 | 288 |
| 28.5 | 237 | 243 | 249 | 255 | 261 | 267 | 273 | 279 | 285 | 291 |
| 29.0 | 240 | 246 | 252 | 258 | 264 | 270 | 276 | 282 | 288 | 294 |
| 29.5 | 243 | 249 | 255 | 261 | 267 | 273 | 279 | 285 | 291 | 297 |
| 30.0 | 246 | 252 | 258 | 264 | 270 | 276 | 282 | 288 | 294 | 300 |
| 30.5 | 249 | 255 | 261 | 267 | 273 | 279 | 285 | 291 | 297 | 303 |
| 31.0 | 252 | 258 | 264 | 270 | 276 | 282 | 288 | 294 | 300 | 306 |
| 31.5 | 255 | 261 | 267 | 273 | 279 | 285 | 291 | 297 | 303 | 309 |
| 32.0 | 258 | 264 | 270 | 276 | 282 | 288 | 294 | 300 | 306 | 312 |
| 32.5 | 261 | 267 | 273 | 279 | 285 | 291 | 297 | 303 | 309 | 315 |
| 33.0 | 264 | 270 | 276 | 282 | 288 | 294 | 300 | 306 | 312 | 318 |
| 33.5 | 267 | 273 | 279 | 285 | 291 | 297 | 303 | 309 | 315 | 321 |
| 34.0 | 270 | 276 | 282 | 288 | 294 | 300 | 306 | 312 | 318 | 324 |
| 34.5 | 273 | 279 | 285 | 291 | 297 | 303 | 309 | 315 | 321 | 327 |
| 35.0 | 276 | 282 | 288 | 294 | 300 | 306 | 312 | 318 | 324 | 330 |
| 35.5 | 279 | 285 | 291 | 297 | 303 | 309 | 315 | 321 | 327 | 333 |
| 36.0 | 282 | 288 | 294 | 300 | 306 | 312 | 318 | 324 | 330 | 336 |

SHOE SHAPE SELECTION METHOD, SHOE SHAPE SELECTION SYSTEM AND SHOE TIP SHAPE SELECTION METHOD

TECHNICAL FIELD

The present invention relates to a method and system of shoe shape selection for selecting an appropriate shoe shape from a plurality of kinds of shoe shapes which have been prepared beforehand, based on a plurality of items of data on a customer.

The present invention also relates to a shoe tip profile selection method for selecting a shoe tip profile suited for a customer from a plurality of kinds of shoe tip profiles which have been prepared beforehand.

BACKGROUND ART

A shoe shape which fits the feet of a customer has been heretofore selected by looking up a chart such as the JIS chart shown in FIG. 10 with measurement values of foot length, foot girth and the like. There have been proposed several methods for selecting a shoe shape based on measurements of various parts of feet. One example is such that foot length, foot width, plantar arch and foot curvatures (the curvatures of the medial and side edges of a foot relative to the base point of the heel) are first measured, and then, a shoe shape is determined based on the measurement values (see Japanese Patent Publication No. 3041039). Apart from this, there have been proposed several methods of determining a shoe shape which fits a customer by use of foot measurement data (see, for example, Japanese Patent Publications Nos. 3041038, 3025530; Japanese Published Unexamined Patent Applications No. H11-282869, H10-260722).

However, it was found to be difficult to select a shoe shape which provides satisfactory foot comfort to the customer by measurements of foot length, foot girth and the conventional parameters (foot curvatures etc.). Therefore, customers, in fact, used to test-fit shoes of several types to select one shoe shape therefrom. However, such test-fitting is difficult for customers who purchase footwear, for instance, via mail order.

DISCLOSURE OF THE INVENTION

The invention is directed to overcoming the above problem and a primary object of the invention is therefore to provide a shoe shape selection method and system for selecting a shoe shape which provides satisfactory foot comfort to the customer without test-fitting.

Another object of the invention is to provide a shoe tip profile selection method for selecting a shoe tip suited for the customer.

The above object can be accomplished by a shoe shape selection method according to the invention, which is a method for selecting an appropriate shoe shape from a plurality of kinds of shoe shapes prepared beforehand, based on a plurality of items of data on a customer, wherein the plurality of items of data include the foot length of the customer, the foot girth of the customer and the difference between the lengths of the first and second toes of the customer. By taking account of not only the foot length and foot girth of the customer but also the difference between the lengths of the first and second toes, selection of a shoe shape which provides more satisfactory foot comfort to the customer becomes possible.

In the above shoe shape selection method, a shoe shape having a larger shoe length size may be selected, as the difference between the lengths of the first and second toes of the customer is bigger.

In the above shoe shape selection method, the plurality of data items may include the first toe height ratio of the customer. By taking the first toe height ratio into account, selection of a shoe shape which provides more satisfactory foot comfort to the customer becomes possible.

The above object can be accomplished by another shoe shape selection method according to the invention, which is a method for selecting an appropriate shoe shape from a plurality of kinds of shoe shapes prepared beforehand, based on a plurality of items of data on a customer, wherein the plurality of data items include the foot length of the customer, the foot girth of the customer and the first toe height ratio of the customer. By taking account of not only the foot length and foot girth of the customer but also the first toe height ratio, selection of a shoe shape which provides more satisfactory foot comfort to the customer becomes possible.

In the above shoe shape selection method, a shoe shape having a larger shoe length size may be selected, as the first toe height ratio of the customer is higher.

In the above shoe shape selection method, the plurality of data items may include the customer's preference of the fit property of shoes. For giving satisfactory foot comfort to the customer, it is important that the shoes have a fit property which is in tune with the customer's preference. For instance, it is important to provide tight shoes to customers who like a tight fit and loose shoes to customers who like a loose fit. Consideration of the customer's preference of fit enables selection of a shoe shape which provides more satisfactory foot comfort to the customer.

The above object can be accomplished by another shoe shape selection method according to the invention, which is a method for selecting an appropriate shoe shape from a plurality of kinds of shoe shapes prepared beforehand based on a plurality of items of data on a customer, wherein the plurality of data items include the foot length of the customer, the foot girth of the customer and the customer's preference of the fit property of shoes. For giving satisfactory foot comfort to the customer, it is important that the shoes have a fit property which is in tune with the customer's preference. For instance, it is important to provide tight shoes to customers who like a tight fit and loose shoes to customers who like a loose fit. By taking account of not only the foot length and foot girth of the customer but also his preference of fit, selection of a shoe shape which gives satisfactory foot comfort to the customer becomes possible.

The above object can be accomplished by a shoe shape selection system according to the invention, which comprises inputting means, selecting means and outputting means, wherein the inputting means inputs a plurality of items of data on a customer to the selecting means which in turn selects an appropriate shoe shape from a plurality of kinds of shoe shapes prepared beforehand, based on the plurality of data items input by the inputting means and then the outputting means outputs the result of the selection done by the selecting means, and wherein the plurality of data items include the foot length of the customer, the foot girth of the customer and the difference between the lengths of the first and second toes of the customer. By taking account of not only the foot length and foot girth of the customer but also the difference between the lengths of the first and second toes, selection of a shoe shape which provides more satisfactory foot comfort to the customer becomes possible.

The above object can be accomplished by a shoe tip profile selection method according to the invention, which is for selecting an appropriate shoe tip profile from a plurality of kinds of shoe tip profiles prepared beforehand, based on the angle of inward inclination of the first toe of a customer and/or the difference between the lengths of the first and second toes of the customer.

In the above shoe tip profile selection method, if the angle of inward inclination of the first toe of the customer is equal to or smaller than a first angle, an oblique type shoe tip is selected, whereby the reactive force of the interior of the shoe imposed on the side face of the first toe is prevented from excessively increasing so that a satisfactory foot comfort can be given to the customer.

In the above shoe tip profile selection method, if the angle of inward inclination of the first toe of the customer is equal to or large than a second angle, the oblique type shoe tip profile is selected, which alleviates the adverse effects on hallux valgus.

In the above shoe tip profile selection method, if the difference between the lengths of the first and second toes of the customer is equal to or higher than a specified value, the oblique type shoe tip profile is selected, whereby the reactive force of the interior of the shoe imposed on the side face of the first toe is prevented from excessively increasing so that a satisfactory foot comfort can be given to the customer.

These objects as well as other objects, features and advantages of the invention will become apparent to those skilled in the art from the following description with reference to the accompanying drawings.

BRIEF EXPLANATION OF THE DRAWINGS

FIG. 8 is a table showing the result of a test for checking the degree of satisfaction obtained by test-fitting.

FIG. 10 is a JIS shoe size look-up chart.

BEST MODE FOR CARRYING OUT THE INVENTION

Referring now to the accompanying drawings, a shoe shape selection method will be described according to one embodiment of the invention. In this embodiment, the foot length, foot girth, difference between the lengths of the first and second toes, and first toe height ratio of a customer's foot are measured and the data of the measurements are used. The customer's preference of the fit property of shoes is obtained. Then, a shoe shape is determined based on these measurement values and the customer's preference of fit.

Herein, "shoe shape" refers to the shape of a shoe specified by "shoe length size" and "shoe width type" relative to the shoe length size. "Shoe length size" refers to the size of a shoe in a longitudinal direction. "Shoe width type" refers to the type relating to the width of a shoe relative to shoe length size.

Herein, "selection of a shoe shape" refers to not only selection of an appropriate shape from various shapes of shoes but also selection of a suitable one from various shapes of lasts (which are forms in the shape of a human foot used for manufacture of shoes).

Figure 1A:
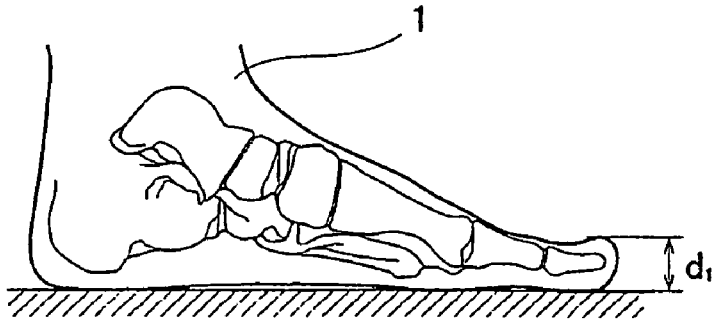
FIG. 1 is views of a foot 1, wherein FIG. 1(*a*) is a side view of a left foot and FIG. 1(*b*) is a plan view of the left foot.
Figure 1:
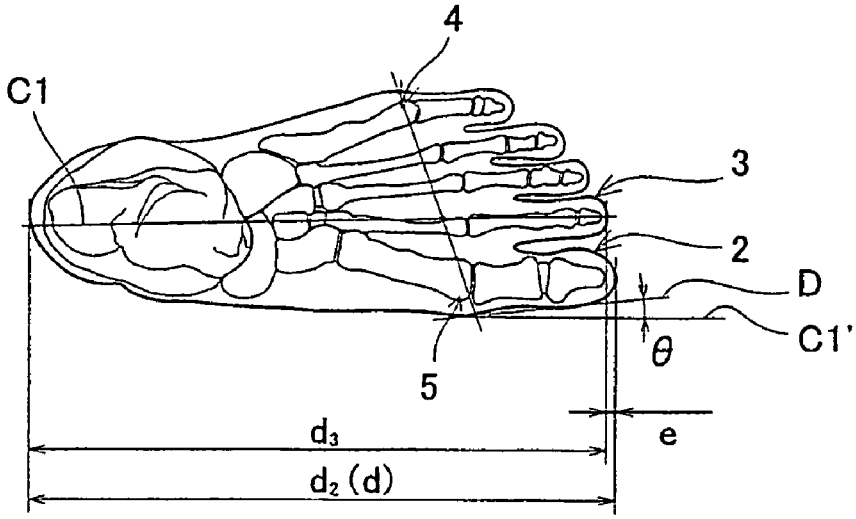

FIG. 1 is views of a foot 1, wherein FIG. 1(*a*) and FIG. 1(*b*) are a side view and plan view, respectively, of a left foot. With reference to these figures, "foot length", "foot girth", "first-second toe length difference" and "first toe height ratio" will be explained.

"Foot length" refers to the length from the heal to the tiptoe. "Tiptoe" refers to the tip of longer one of the first toe 2 and the second toe 3. If the first toe 2 is longer, the distance d2 from the heal to the tip of the first toe 2 is the foot length d. If the second toe 3 is longer, the distance d3 from the heal to the tip of the second toe 3 is the foot length d.

"Foot girth" refers to the transverse circumference around the foot measured at the part between the fifth metatarsal head 4 and the first metatarsal head 5.

"First-second toe length difference" refers to the difference between the lengths of the first toe 2 and the second toe 3. That is, the first-second toe length difference e is the difference between the distance d2 from the heel to the tip of the first toe and the distance d3 from the heel to the tip of the second toe ($e=d2-d3$). If the first toe 2 is longer than the second toe 3, e is a positive value ($d2-d3>0$). On the other hand, if the first toe 2 is shorter than the second toe 3, e is a negative value ($d2-d3<0$).

"First toe height ratio" is the ratio of the height of the upper face of the first toe 2 measured from the floor surface to the foot length. More specifically, the first toe height ratio f is the ratio between longer one (d) of the distances d2 and d3 and the height d1 of the upper face of the first toe 2 measured from the floor surface ($f=d1/d$).

"Fit property" refers to the degree of tightness of shoes felt by the customer. This (fit property) is thought to be the grade of reactive force which the foot receives from the interior of a shoe.

For selection of a shoe shape, the foot length d of the customer; the foot girth of the customer; the height d1 of the upper face of the first toe 2 from the floor surface; the distance d2 from the heel to the tip of the first toe 2; and the distance d3 from the heal to the tip of the second toe 3 are first measured. From these measurement values, the first-second toe length difference e ($e=d2-d3$) and the first toe height ratio f ($f=d1/d$) are calculated. Then, the customer selects his preference of fit from "tight", "slightly tight", "medium", "slightly loose", "loose" (asking the customer for confirmation).

Then, a shoe length size is temporarily determined based on only the data of the foot length d. Concretely, the nearest shoe size to the foot length d is selected from various shoe length sizes increased by 5 mm (e.g., . . . 240 mm, 245 mm, 250 mm, 255 mm . . . ) and determined as a temporal shoe length size.

Then, a certain length is added to the temporally determined shoe length size, thereby obtaining a final shoe length size.

Based on the temporally determined shoe length size and the measured foot girth, a shoe width type is determined.

Thus, the shoe length size (the finally determined shoe length size) and the shoe width type are determined, so that a shoe shape to be selected can be specified.

The shoe selection method will be more concretely described below.

Figure 2:
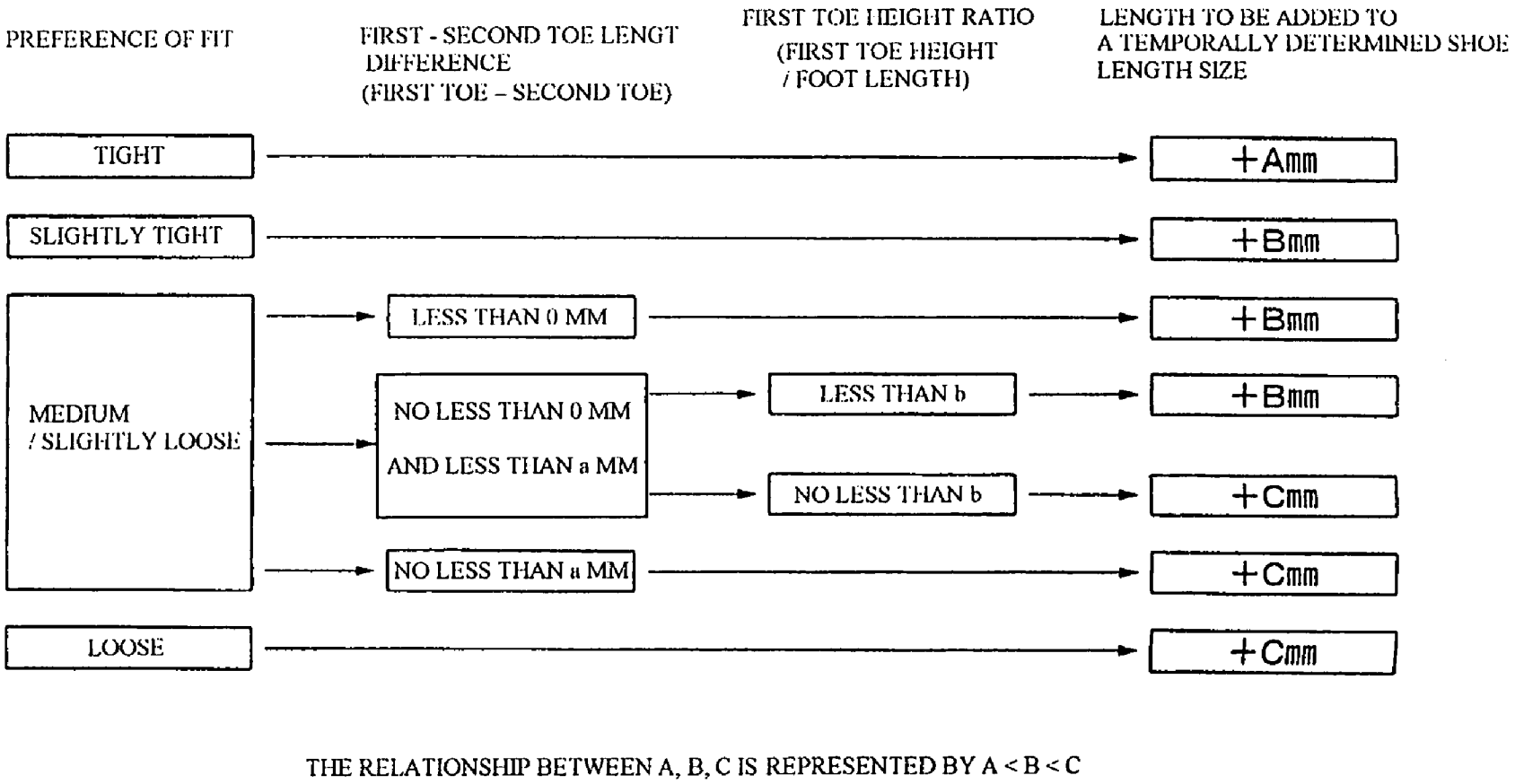
FIG. 2 is a chart of a procedure for determining a shoe length size.

After a shoe length size is temporally determined based on only the data on the foot length d, a certain length is added to the temporal shoe length size, thereby obtaining a final shoe length size. FIG. 2 is a chart showing a procedure for determining this "certain length to be added". In FIG. 2, all of "A", "B", "C", "a", "b" are a positive number, and "0<a" and "A<B<C" hold.

This chart (FIG. 2) is for running shoes. Running shoes are generally designed to provide feet with a tight fit, compared to other types of shoes. Although the clearance between the surface of the foot and the interior face of the shoe is relatively small, the interior of the shoe is made of materials having cushioning properties (e.g., sponge and cloths). The materials having cushioning properties (e.g., sponge and cloths) are relatively thick. In addition, in consideration of the fact that the feet are significantly distorted under load during physical exercise, running shoes are usually designed to have a shoe length size larger than the measurement value of foot length.

With reference to the chart of FIG. 2., the method will be explained below. If the customer's preference of fit is "tight", A mm is determined to be "the length to be added", irrespective of the first-second toe length difference e and the first toe height ratio f. That is, the value obtained by adding A mm to the temporal shoe length size determined based on only the foot length d is determined to be the final shoe length size.

If the customer's preference of fit is "slightly tight", B mm is determined to be "the length to be added", irrespective of the first-second toe length difference e and the first toe height ratio f. That is, the value obtained by adding B mm to the temporal shoe length size based on only the foot length d is determined to be the final shoe length size.

If the customer's preference of fit is "medium" or "slightly loose", the first-second toe length difference is further taken into account.

If the customer's preference of fit is "medium" or "slightly loose" and the first-second toe length difference is "less than 0 mm", B mm is determined to be "the length to be added", irrespective of the first toe height ratio f. That is, the value obtained by adding B mm to the temporal shoe length size based on only the foot length d is determined to be the final shoe length size.

If the customer's preference of fit is "medium" or "slightly loose" and the first-second toe length difference is "0 mm or more and less than a mm", the first toe height ratio is further taken into account.

If the customer's preference of fit is "medium" or "slightly loose"; the first-second toe length difference is "0 mm or more and less than a mm"; and the first toe height ratio is "less than b", B mm is determined to be "the length to be added". That is, the value obtained by adding B mm to the temporal shoe length size based on only the foot length d is determined to be the final shoe length size.

If the customer's preference of fit is "medium" or "slightly loose"; the first-second toe length difference is "0 mm or more and less than a mm"; and the first toe height ratio is "b or more", C mm is determined to be "the length to be added". That is, the value obtained by adding C mm to the temporal shoe length size based on only the foot length d is determined to be the final shoe length size.

If the customer's preference of fit is "medium" or "slightly loose" and the first-second toe length difference is "a mm or more", C mm is determined to be "the length to be added", irrespective of the first toe height ratio f. That is, the value obtained by adding C mm to the temporal shoe length size based on only the foot length d is determined to be the final shoe length size.

If the customer's preference of fit is "loose", C mm is determined to be "the length to be added", irrespective of the first-second toe length difference e and the first toe height ratio f. That is, the value obtained by adding C mm to the temporal shoe length size based on only the foot length d is determined to be the final shoe length size.

As the customer chooses a looser fit as the fit property, a shoe shape having a larger shoe length size is selected. As the first-second toe length difference is bigger, a shoe shape having a larger shoe length size is selected. Further, as the first toe height ratio is higher, a shoe shape having a larger shoe length size is selected.

Reference is made to FIG. 2 to make a more concrete explanation. A case where the temporal shoe length size determined based on only the measurement value of foot length is 250 mm is taken for example. If the customer likes "tight" as the fit property of shoes, (250+A) mm obtained by adding A mm to the temporal shoe length size of 250 mm is determined to be the final shoe length size.

If the customer chooses "slightly tight" as the fit property of shoes, (250+B) mm obtained by adding B mm to the temporal shoe length size of 250 mm is determined to be the final shoe length size.

If the customer chooses "medium" or "slightly loose" as the fit property of shoes and the first-second toe length difference is "less than 0 mm", (250+B) mm obtained by adding B mm to the temporal shoe length size of 250 mm is determined to be the final shoe length size.

If the customer chooses "medium" or "slightly loose" as the fit property of shoes; the first-second toe length difference is "0 mm or more and less than a mm"; and the first toe height ratio is "less than b", (250+B) mm obtained by adding B mm to the temporal shoe length size of 250 mm is determined to be the final shoe length size.

If the customer chooses "medium" or "slightly loose" as the fit property of shoes; the first-second toe length difference is "0 mm or more and less than a mm"; and the first toe height ratio is "b or more", (250+C) mm obtained by adding C mm to the temporal shoe length size of 250 mm is determined to be the final shoe length size.

If the customer chooses "medium" or "slightly loose" as the fit property of shoes and the first-second toe length difference is "a mm or more", (250+C) mm obtained by adding C mm to the temporal shoe length size of 250 mm is determined to be the final shoe length size.

If the customer chooses "loose" as the fit property of shoes, (250+C) mm obtained by adding C mm to the temporal shoe length size of 250 mm is determined to be the final shoe length size.

After the shoe length size is finally determined with the procedure shown in FIG. 2 as described above, a shoe width type is determined based on the temporal shoe length size and the measurement value of foot girth. In this embodiment, the shoe width type is determined to be any one of three types (Type 1, Type 2 and Type 3). For instance, Type 1 may be a shoe width type similar to JIS width B shown in FIG. 10; Type 2 may be a shoe width type similar to JIS width E shown in FIG. 10 and Type 3 may be a shoe width type similar to JIS width EEEE shown in FIG. 10.

Thus, a shoe shape is specified by the finally determined shoe length size and the determined shoe width type.

After specifying a shoe shape, the last corresponding to this shoe shape is selected from a plurality of lasts prepared beforehand. A shoe is made by use of the selected last, so that the desirable shoe which satisfies the customer can be produced. For instance, if a shoe shape, whose shoe length size is 260 mm and shoe width type is Type 2, is specified, the last corresponding to this shoe shape is selected and a shoe, whose shoe length size is 260 mm and shoe width type is Type 2, may be produced, using this last.

It is also possible to directly select a shoe instead of a last. That is, after specifying a shoe shape, a shoe having this shoe shape is selected from a plurality of kinds of shoes prepared beforehand. For instance, if a shoe shape, whose shoe length size is 260 mm and shoe width type is Type 2, is specified, a shoe of Type 2 having a shoe length size of 260 mm is selected and provided for the customer.

A method of finally determining a shoe length size through the procedure shown in FIG. 2 has been explained hereinabove. In FIG. 2, when finally determining a shoe length size, a length to be added to a shoe length size temporally determined based on the data of the foot length d only is determined based upon the customer's preference of fit, the first-second toe length difference e, and the first toe height ratio f.

However, the length to be added to the temporal shoe length size determined based on the data of foot length d only may be determined based upon the customer's preference of fit alone to obtain a final shoe length size.

It is also possible to determine the length to be added to the temporal shoe length size, based upon the first toe height ratio f alone to obtain a final shoe length size.

It is also possible to determine the length to be added to the temporal shoe length size, based upon the first-second toe length difference e alone to obtain a final shoe length size.

Although the three values "A", "B" and "C" are used as the length to be added to the temporal shoe length size in the above description, the value of the length to be added may vary depending on the used data.

Figure 3:
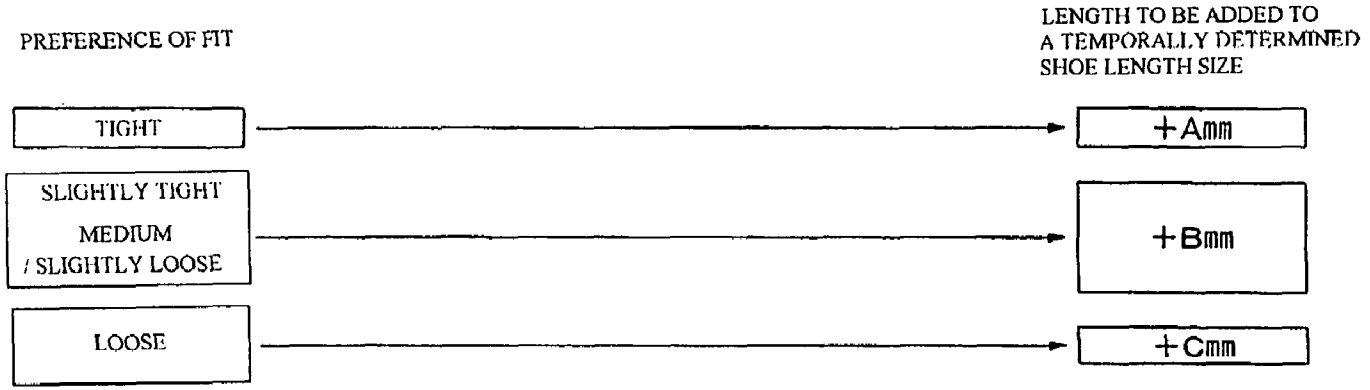
FIG. 3 is charts of procedures, wherein FIG. 3(*a*), FIG. 3(*b*) and FIG. 3 (*c*) are charts for determining a shoe length size.
Figure 3:
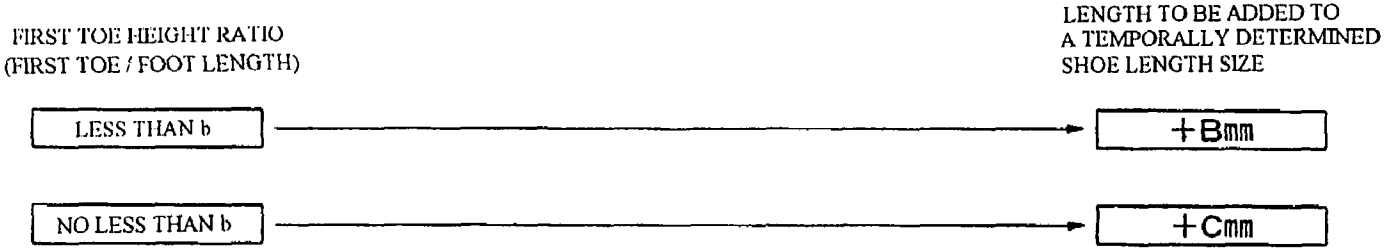
Figure 3:
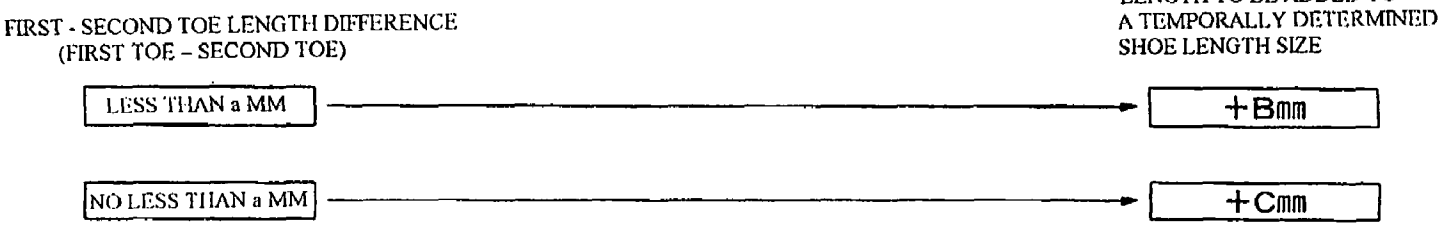

FIG. 3 shows charts of methods for determining a final shoe length size. These charts are associated with running shoes. In FIG. 3, all of "A", "B", "C", "a" and "b" are a positive number, and "0<a" and "A<B<C" hold.

FIG. 3(*a*) is a chart of a method for determining the final shoe length size based upon "the customer's preference of fit" alone. Referring to FIG. 3(*a*), if "the customer's preference of fit" is "tight", the value obtained by adding A mm to the temporal shoe length size is determined as the final shoe length size. If "the customer's preference of fit" is "slightly tight", "medium" or "slightly loose", the value obtained by adding B mm to the temporal shoe length size is determined as the final shoe length size. If "the customer's preference of fit" is "loose", the value obtained by adding C mm to the temporal shoe length size is determined as the final shoe length size.

FIG. 3(*b*) is a chart of a method for determining the final shoe length size based upon "the first toe height ratio" alone. Referring to FIG. 3(*b*), if "the first toe height ratio" is "lower than b", the value obtained by adding B mm to the temporal shoe length size is determined as the final shoe length size. If "the first toe height ratio" is "equal to or higher than b", the value obtained by adding C mm to the temporal shoe length size is determined as the final shoe length size.

FIG. 3(*c*) is a chart of a method for determining the final shoe length size based upon "the first-second toe length difference" alone. Referring to FIG. 3(*c*), if "the first-second toe length difference" is "less than a mm", the value obtained by adding B mm to the temporal shoe length size is determined as the final shoe length size. If "the first-second toe length difference" is "equal to or more than a mm", the value obtained by adding C mm to the temporal shoe length size is determined as the final shoe length size.

There have been described, with reference to FIG. 3, methods of determining a final shoe length size by adding a certain length to a shoe length size temporally determined based on only the data of the foot length d, in which the certain length is determined based upon "the customer's preference of fit" alone, "the first toe height ratio f" alone or "the first-second toe length difference e" alone.

Although the three values "A", "B", "C" are used as the length to be added to the temporal shoe length size in the above description, the value of the length to be added may vary depending on the used data.

Now, the relationship between "the fit property" of shoes and the reactive force which the foot receives from the interior of the shoe will be discussed.

Figure 4:
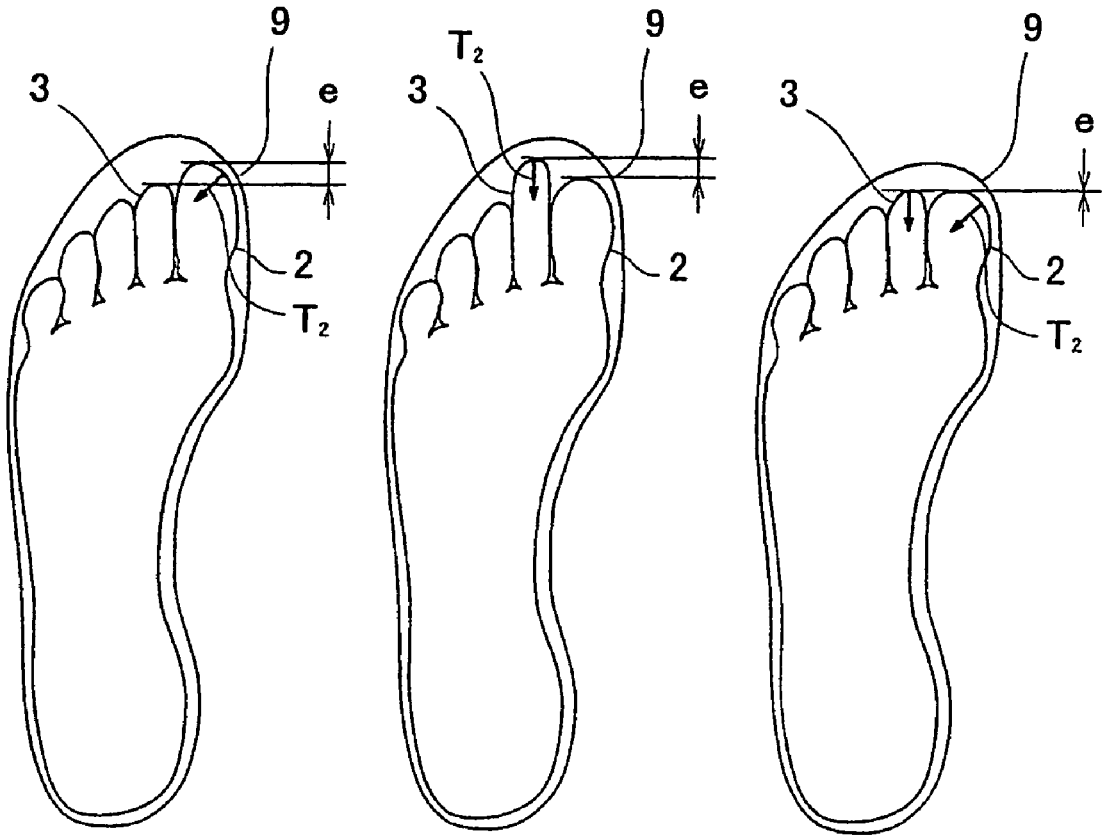
FIG. 4 is perspective plan views of a shoe, wherein FIG. 4(*a*) shows a case where the first toe is longer than the second toe, FIG. 4(*b*) shows a case where the first toe is shorter than the second toe and FIG. 4(*c*) shows a case where the first toe and the second toe have substantially the same length.

FIG. 4 is perspective plan views of a shoe, wherein FIG. 4(*a*) shows a case where the first toe 2 is longer than the second toe 3, FIG. 4(*b*) shows a case where the first toe 2 is shorter than the second toe 3 and FIG. 4(*c*) shows a case where the first toe 2 and the second toe 3 have substantially the same length. With reference to FIG. 4, the relationship between the value to be added to the shoe length size shown in FIG. 2 and the fit property will be explained.

The value to be added to the shoe length size varies depending on the type of shoes. In the invention, ordinary running shoes are taken for example. T2 represents the reactive force of the interior of the shoe imposed on the front faces of the tips of the first and second toes, which front faces are the most sensitive to "the fit property".

When using FIG. 4(*b*) (which shows a case where the first-second toe length difference is "less than 0 mm") as a reference case, the value to be added to the shoe length size of FIG. 4(*a*) (which shows a case where the first-second toe length difference is "equal to or more than a mm") is larger than that of the case where the first-second toe length difference is "less than 0 mm". The reason for this is as follows. The shoe curves from the vicinity of the first toe 2 to the tip of the shoe as indicated by numeral 9. Therefore, in order to provide the shoe of FIG. 4(*a*) with the same fit property (i.e., the same degree of reactive force T2 from the interior of the shoe) as that of the case shown in FIG. 4(*b*) where the first toe 2 is shorter than the second toe 3, the size of the shoe of FIG. 4(*a*) has to be made larger than that of FIG. 4(*b*).

When using FIG. 4(*b*) (which shows a case where the first-second toe length difference is "less than 0 mm") as a reference case, the shoe size varies depending on the first toe height ratio in the case (where the first-second toe length difference is "0 mm or more and less than a mm") of FIG. 4(*c*).

Figure 5:
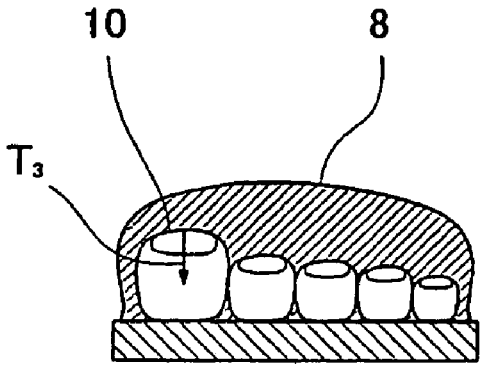
FIG. 5 is perspective front views of a shoe, wherein FIG. 5(*a*) shows a case where the first toe has an average thickness and FIG. 5(*b*) shows a case where the first toe is relatively thick.
Figure 5:
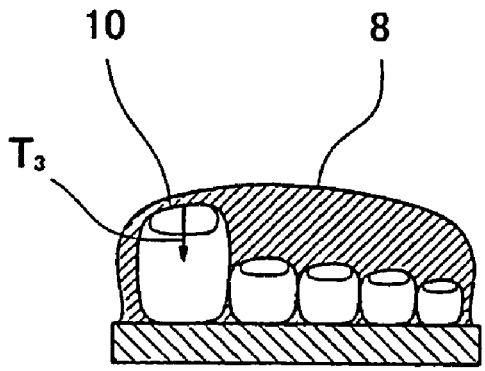
Figure 6:
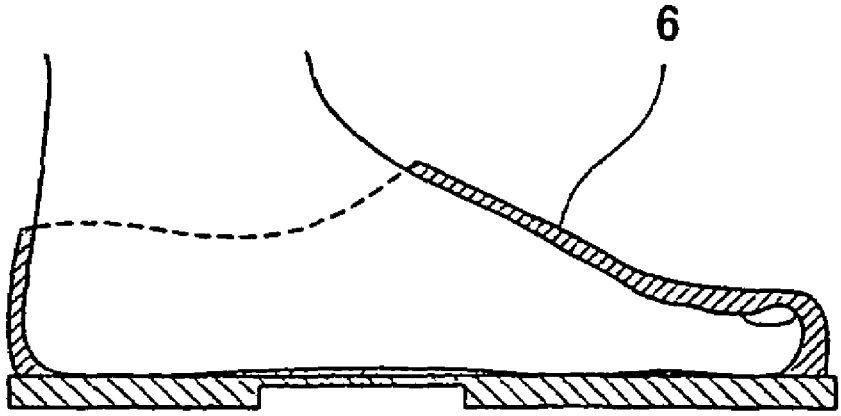
FIG. 6 is perspective side views of a shoe, wherein FIG. 6(*a*) shows the relationship between the shoe and the foot and FIG. 6(*b*) shows an enlarged view of the tiptoe portion.
Figure 6:
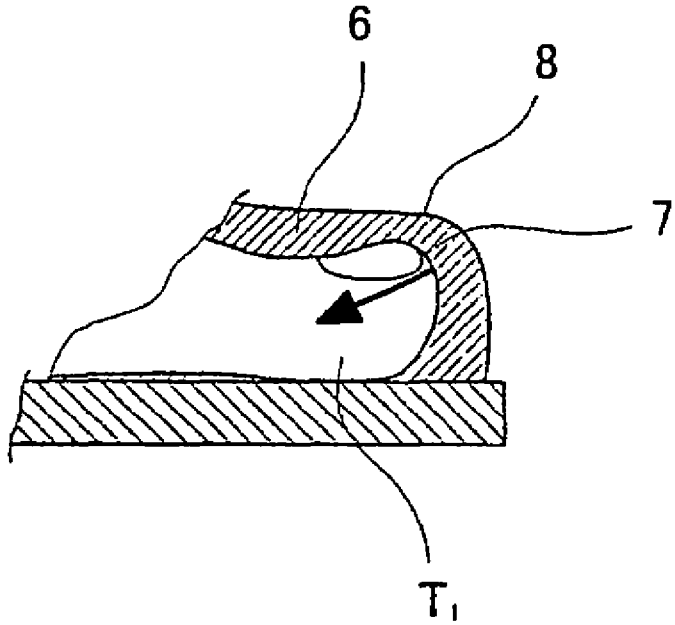

FIG. 5 is perspective front views of a shoe, wherein FIG. 5(*a*) shows a case where the first toe height ratio is "lower than b" and the other conditions are the same as of FIG. 4(*c*) and FIG. 5(*b*) shows a case where the first toe height ratio is "equal to or higher than b" and the other conditions are the same as of FIG. 4(*c*). FIG. 6 is perspective side views of the shoe. Reference is made to FIGS. 5 and 6 to describe the relationship between the value to be added to the temporal shoe length size and the fit property.

To provide the shoe of FIG. 5(*a*) with the same fit property as of FIG. 4(*b*), in other words, to make the reactive force T3 of the interior of the shoe of FIG. 5(*a*) equal to the reactive force T2 of the interior of the shoe of FIG. 4(*b*), there is no need to increase the shoe size of FIG. 5(*a*). Concretely, the tip curved portion 8 shown in FIG. 6(*b*) more gently curves toward the tiptoe than the tip curved portion 9 shown in FIG. 4, and the reactive force T2 received from an interior part in the vicinity of the tip curved portion 9 is greater than the reactive force T3 received from an interior part in the vicinity of the tip curved portion 8. Therefore, even if the shoe of FIG. 5(*a*) has the same shoe size as that of the shoe of FIG. 4(*b*), there is no difference between these shoes in terms of the reactive force received from the interior parts of the shoes.

To provide the shoe of FIG. 5(*b*) with the same fit property as of FIG. 4(*b*), in other words, to make the reactive force T3 of the interior of the shoe of FIG. 5(*b*) equal to the reactive force T2 of the interior of the shoe of FIG. 4(*b*), the shoe size of FIG. 5(*b*) has to be increased. Concretely, the tip curved portion 8 shown in FIG. 6(*b*) more gently curves toward the tiptoe than the tip curved portion 9 shown in FIG. 4 and the reactive force T2 received from the interior part in the vicinity of the tip curved portion 9 is smaller than the reactive force T3 received from the interior part in the vicinity of the tip curved portion 8. Therefore, unless the shoe size is increased by the thick portion of the first toe 2, a difference in reactive force will be caused.

In this embodiment, the assessment of the fit property is represented by "tight", "slightly tight", "medium", "slightly loose" and "loose". "Tight" means that the first toe 2 or the second toe 3 receives a significantly strong reactive force from the interior of the shoe. "Slightly tight" means that the first toe 2 or the second toe 3 receives a strong reactive force from the interior of the shoe. "Medium" and "slightly loose" mean that the first toe 2 or the second toe 3 receives a little reactive force from the interior of the shoe. "Loose" means that the first toe 2 or the second toe 3 receives little reactive force from the interior of the shoe.

The relationship between "the fit property" of the shoe and the reactive force that the foot receives from the interior of the shoe has been discussed hereinabove.

Various forms embodying the shoe shape selection method of the invention have been described hereinabove. This shoe shape selection method can be effectively used for shoes sales systems which do not provide test-fitting, by making use of information distribution means. This method is particularly suited for, for example, cases where the customer gives information on his feet and his preference of fit to the manufacturer or retailer by means of telephone or facsimile, and the manufacturer or retailer manufactures or selects shoes based on the information to deliver to the customer. Examples of such cases are mail-order selling and sales in which the retailer sells shoes without having stocks.

Figure 7:
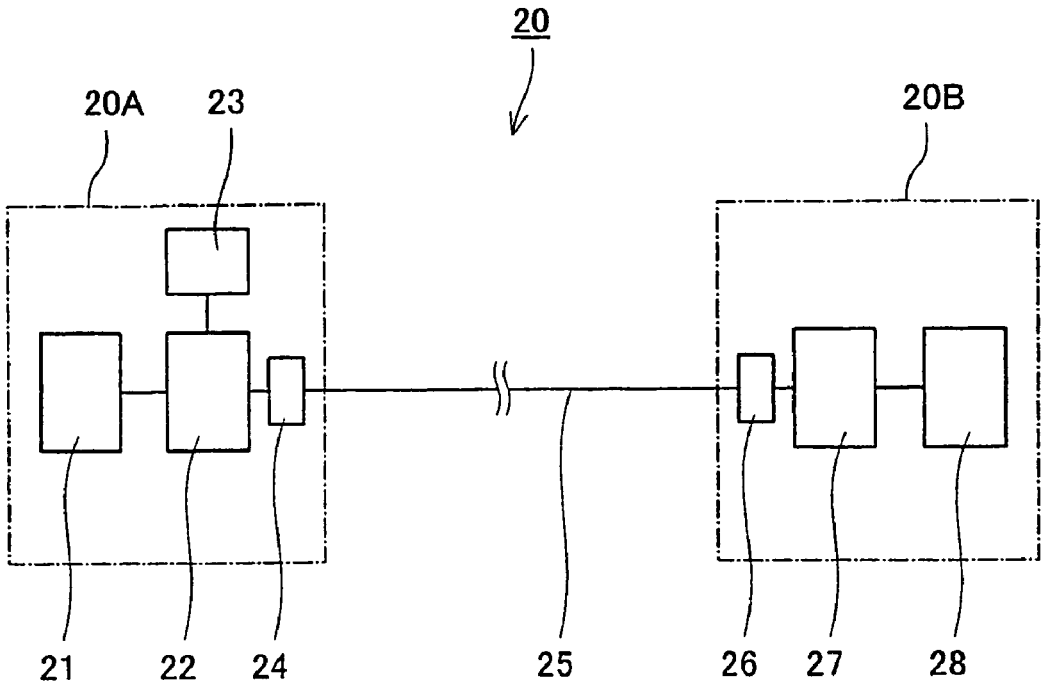
FIG. 7 is a schematic structural diagram of a shoe shape selection system.

FIG. 7 is a schematic structural diagram showing one embodiment of the shoe shape selection system for implementing the above-described shoe shape selection method.

Referring to FIG. 7, a shoe shape selection system 20 has, on a terminal station side 20A (e.g., shop), a three-dimensional measuring instrument 21, a personal computer main unit 22 and a keyboard 23. The system 20 has, on a base station side 20B (e.g., production site), a personal computer main unit 27 and a display unit (display) 28. The personal computer main units 22, 27 are connected to each other through communication interfaces 24, 26 by a communication line 25.

The three-dimensional measuring instrument 21 provides three-dimensional measurement data on a human foot put thereon, by measuring the three-dimensional coordinates of many points on the surface of the human foot.

The three-dimensional measurement data is sent to the personal computer main unit 22 which, in turn, calculates foot length, foot girth, first-second toe length difference, first toe height, and first toe height ratio, based on the three-dimensional measurement data. The operator on the terminal station side 20A checks the customer's preference of fit and inputs the data on it to the personal computer main unit 22, using the keyboard 23.

These data items (foot length, foot girth, first-second toe length difference, first toe height, first toe height ratio, and the customer's preference of fit) are sent to the personal computer main unit 27 on the base station side 20B through the communication line 25.

A plurality of kinds of shoe shapes are stored in a memory means (not shown) of the personal computer main unit 27 on the base station side 20B. The personal computer main unit 27 selects a shoe shape based on the data received through the communication line 25, using the shoe shape selection method described earlier. The display unit 28 displays the data on the selected shoe shape. For instance, the display unit 28 indicates "shoe length size: 260 mm, shoe width type: Type 2". Based on the content of the display, suitable lasts or suitable shoes can be selected on the base station side 20B. It should be noted that the personal computer main unit 27 functions as the selecting means for selecting a shoe shape and the display unit 28 functions as the outputting means for outputting the result of the selection.

One form embodying the shoe shape selection system of the invention has been described hereinabove with reference to FIG. 7.

The applicant checked the effectiveness of the shoe shape selection method of the invention by a test conducted on trial subjects. The test result is shown in FIG. 8.

In this test, measurement data on the feet of the trial subjects were obtained and the trial subjects were asked about their preference of fit. Based on these data items, shoe sizes for the trial subjects were finally determined by the methods shown in FIGS. 2, 3(*a*), 3(*b*) and 3(*c*). Also, the foot width type for each trial subject was determined based on the temporally determined shoe length size and foot girth. Then, the trial subjects test-fitted the shoes corresponding to their respective determined shoe length sizes and foot width types and their satisfaction about the foot comfort of the shoes was checked by questionnaire survey. The method is evaluated by the percentage of satisfaction obtained in test-fitting. In the table, the percentage of satisfaction is represented by the ratio between the number of test-fitted shoes and the index of satisfaction. That is, the percentage of satisfaction=(the index of satisfaction)/(the number of test-fitted shoes). The index of satisfaction is the total number of votes which answered that the selected shoes were "very satisfactory" or "satisfactory" when the questionnaire survey was made. In the questionnaire survey, the degree of satisfaction is represented by four levels, that is, "very satisfactory"; "satisfactory"; "unsatisfied"; and "very unsatisfied" was made.

In the table of FIG. 8, D designates the test result when the final shoe length size was determined with the method shown in FIG. 2. The percentage of satisfaction is 87.8%.

In the table of FIG. 8, E designates the test result when the final shoe length size was determined with the method shown in FIG. 3(*a*). The percentage of satisfaction is 80.5%.

In the table of FIG. 8, F designates the test result when the final shoe length size was determined with the method shown in FIG. 3(*b*). The percentage of satisfaction is 80.0%.

In the table of FIG. 8, G designates the test result when the final shoe length size was determined with the method shown in FIG. 3(*c*). The percentage of satisfaction is 74.5%.

In the table of FIG. 8, H designates the test result of the conventional shoe shape selection method, that is, the method of selecting a shoe shape by looking up the JIS chart shown in FIG. 10 with only foot length and foot girth. The percentage of satisfaction is 67.1%.

The percentages of satisfaction designated by D to G in the table of FIG. 8 are all higher than the percentage of satisfaction designated by H. Accordingly, the shoe shape selection methods of the invention have proved to be effective.

The result of the test made for checking the effectiveness of each of the shoe shape selection methods of the invention has been explained hereinabove with reference to FIG. 8.

Figure 9:
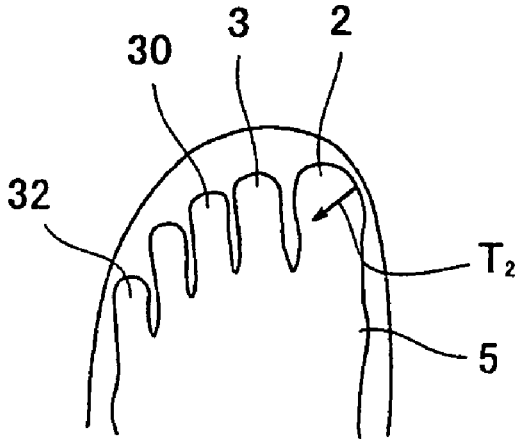
FIG. 9 is views each showing the profile of a shoe tip, wherein FIG. 9(*a*) shows a round-type shoe tip profile and FIG. 9(*b*) is an oblique-type shoe tip profile.
Figure 9:
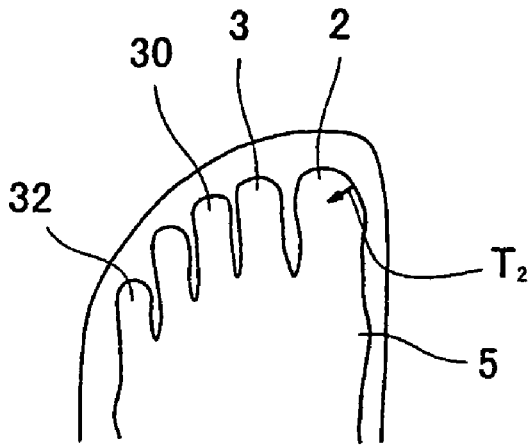

Next, reference is made to FIG. 9 to describe one embodiment of the shoe tip profile selection method of the invention. In this embodiment, an appropriate shoe tip profile is selected from a plurality of shoe tip profiles based on the angle of inward inclination of the first toe of the customer and the first-second toe length difference of the customer.

Herein, "selection of a shoe tip profile" means not only selection of a shoe having an appropriate shoe tip profile from shoes having various shoe tip profiles but also selection of a last having an appropriate shoe tip profile from lasts (forms in the shape of the human foot used for manufacture of shoes) having various shoe tip profiles.

Herein, "the angle of inward inclination of the first toe" refers to the angle indicated by θ in FIG. 1(*b*). More specifically, it is the angle of the side face of the first toe 2 which inwardly inclines from the central line C1 of the foot in plan (or in a bottom view), the side face being on the opposite side of the second toe 3. In FIG. 1(*b*), the line D is a tangent to the side face of the first toe 2 on the opposite side of the second toe 3, and the line C1' is a parallel line relative to the central line C1. "The first-second toe length difference" refers to the difference in length between the first toe 2 and the second toe 3 as explained earlier and designated by "e" in FIG. 1(*b*).

The tip profile of shoes affects the foot comfort etc. of the shoes. Shoe tip profiles are roughly classified into "the round type" and "the oblique type". Although there is a shoe tip profile called "the square type", it is not popular.

FIG. 9 is views each showing a shoe tip profile together with a toe. Specifically, FIG. 9(*a*) shows a round type shoe tip profile, whereas FIG. 9(*b*) shows an oblique type shoe tip profile.

The round type is a shoe tip profile having substantially symmetrical curves extending to the right and left respectively from the second toe 3 or the third toe 30 serving as an apex. The round type is designed to gently curve from the first metatarsal head 5 toward the tiptoe.

The oblique type is a shoe tip profile having a curve which extends from the first toe 2 serving as an apex and gradually becomes gentle as it goes to the fifth toe 32. The oblique type is designed to be substantially straight from the first metatarsal head 5 to the tiptoe.

A larger number of shoes having the round type shoe tip profile are manufactured, compared to shoes having the oblique type shoe tip profile. The reason for this is that many people like the round type better than the oblique type in terms of the appearance of shoes.

However, it may be better depending on the shape of feet to choose the oblique type in view of the foot comfort of shoes.

For instance, if the angle of inward inclination θ of the first toe 2 is small to an extent that exceeds the normal range, the reactive force T2 of the interior of the shoe imposed on the side face of the first toe 2 tends to be strong as a necessary consequence. If the reactive force T2 is too great, the foot comfort of shoes deteriorates. The reactive force T2 of the interior of the shoe, which is imposed on the side face of the first toe 2, is weak in the oblique type shoe tip profile, compared to that of the round type shoe tip profile. Therefore, in the above case (i.e., the angle of inward inclination θ of the first toe 2 is small to an extent that exceeds the normal range), it is preferable to select the oblique type shoe tip profile.

For instance, when the angle of inward inclination θ of the first toe 2 is large to an extent that exceeds the normal range, it is diagnosed as hallux valgus. To reduce the adverse effects upon hallux valgus, the reactive force T2 of the interior of the shoe imposed on the side face of the first toe 2 should be as small as possible. The reactive force T2 of the interior of the shoe having the oblique type shoe tip profile imposed on the side face of the first toe 2 is smaller than that of the round type shoe tip profile. Therefore, in this case (where the angle of inward inclination θ of the first toe 2 is large to an extent that exceeds the normal range), it is preferable to choose the oblique type shoe tip profile.

If the round type is selected in a case where the first-second toe length difference e is large to an extent that exceeds the normal range, the reactive force T2 of the interior of the shoe imposed on the side face of the first toe 2 is so strong that the foot comfort of the shoe deteriorates. On the other hand, if the oblique type shoe tip profile is selected, the reactive force T2 of the interior of the shoe imposed on the side face of the first toe 2 is relatively small. Therefore, in this case (where the first-second toe length difference e is large to an extent that exceeds the normal range), it is desirable to select the oblique type shoe tip profile.

Concretely, the present embodiment selects a shoe tip profile in the following way. First, the foot shape of the customer is measured by a three-dimensional measuring instrument (e.g., the three-dimensional measuring instrument 21 shown in FIG. 7), and then, "the angle of inward inclination of the first toe" and "the first-second toe length difference" are calculated from the measured foot shape. Based on these values ("the angle of inward inclination of the first toe" and "the first-second toe length difference"), either the round type or the oblique type is selected as the shoe tip profile to be employed. A further detailed description is made as follows (In the following description, the values "α" and "β" are used, and β is larger than α. α may exceed 0 and be no more than 10, whereas β may be no less than 5 and no more than 20).

If the angle of inward inclination θ of the first toe 2 is α° or less, the oblique type is selected irrespective of the value of the first-second toe length difference e. Thereby, even if the angle of inward inclination θ of the first toe 2 is small to an extent that exceeds the normal range, the reactive force T2 of the interior of the shoe imposed on the side face of the first toe 2 can be reduced to such a degree that the reactive force is hardly felt so that good foot comfort can be attained.

If the angle of inward inclination θ is β° or more, the oblique type is selected irrespective of the value of the first-second toe length difference e. Thereby, the reactive force T2 of the interior of the shoe imposed on the side face of the first toe 2 can be reduced to a possible extent in the case of hallux valgus, which contributes to correction of hallux valgus.

If the fist-second toe length difference e is h mm or more (herein, "h" is a positive number) even though the angle of inclination θ is more than α° and less than β°, the oblique type is selected. Thereby, even if the first-second toe length difference e is large to an extent that exceeds the normal range, the reactive force T2 of the interior of the shoe imposed on the side face of the first toe 2 can be reduced to such a degree that the reactive force is hardly felt, so that good foot comfort can be attained.

If the angle of inclination θ is more than α° and less than β° and the first-second foot length difference e is less than h mm, it is determined to be a normal toe shape and therefore the round type which is the most popular in view of its appearance is selected. This makes it possible to satisfy the taste of most people with regard to the appearance of shoes. For the customers having a normal foot shape, whether the shoes have the round type shoe tip profile or the oblique type shoe tip profile does not have big difference in terms of the reactive force T2 of the interior of the shoe imposed on the side face of the first toe 2.

One for embodying the shoe tip profile selection method of the invention has been described hereinabove, mainly referring to FIG. 9.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function maybe varied substantially without departing from the spirit of the invention and all modifications which come within the scope of the appended claims are reserved.

INDUSTRIAL APPLICABILITY

The shoe shape selection method, shoe shape selection system and shoe tip profile selection method of the invention enable selection of a shoe shape which provides a high degree of satisfaction to the customer. In addition, the invention enables selection of a shoe tip profile suited for the customer and is therefore useful for the technical field of shoes.

The invention claimed is:

1. A shoe shape selection system comprising:

inputting means, selecting means and outputting means, wherein the inputting means inputs a plurality of items of data on a customer to the selecting means, the selecting means selects an appropriate shoe shape from a plurality of kinds of shoe shapes prepared beforehand, based on the plurality of data items input by the inputting means, and the outputting means outputs the result of the selection done by the selecting means, wherein the plurality of data items include a foot length of the customer, a foot girth of the customer and a difference between lengths of first and second toes of the customer, wherein the shoe shape selected has a larger shoe length size as the difference between the lengths of the first and second toes of the customer increases.

2. The shoe shape selection system according to claim 1, further comprising wherein the plurality of data items include an angle of inward inclination of a first toe, wherein if the angle of inward inclination of the first toe of the customer is equal to or smaller than a first angle ($\alpha$), an oblique type shoe tip profile is selected.

3. The shoe shape selection system according to claim 1, further comprising wherein the plurality of data items include a angle of inward inclination of a first toe, wherein if the angle of inward inclination of the first toe of the customer is equal to or larger than a second angle ($\beta$), an oblique type shoe tip profile is selected.

4. The shoe shape selection system according to claim 1, wherein if the difference between the lengths of the first and second toes of the customer is equal to or higher than a specified value, an oblique type shoe tip profile is selected.

5. The shoe shape selection system according to claim 1, further comprising wherein the plurality of data items include a customer having a preference of fit, wherein if the preference of fit is medium or slightly loose, the difference between the lengths of the first and second toes of the customer is used as the plurality of data items, wherein the shoe shape selected has a larger shoe length size as the difference between the lengths of the first and second toes of the customer increases.

6. A shoe shape selection system comprising:

inputting means, selecting means and outputting means, wherein the inputting means inputs a plurality of items of data on a customer to the selecting means, the selecting means selects an appropriate shoe shape from a plurality of kinds of shoe shapes prepared beforehand, based on the plurality of data items input by the inputting means, and the outputting means outputs the result of the selection done by the selecting means, wherein the plurality of data items include a foot length of the customer, a foot girth of the customer and a first toe height ratio of the customer, wherein the shoe shape selected has a larger shoe length size as the first toe height ratio of the customer increases.

7. The shoe shape selection system according to claim 6, further comprising wherein the plurality of data items include a angle of inward inclination of a first toe, wherein if the angle of inward inclination of the first toe of the customer is equal to or smaller than a first angle ($\alpha$), an oblique type shoe tip profile is selected.

8. The shoe shape selection system according to claim 6, further comprising wherein the plurality of data items include a angle of inward inclination of a first toe, wherein if the angle of inward inclination of the first toe of the customer is equal to or larger than a second angle ($\beta$), an oblique type shoe tip profile is selected.

9. The shoe shape selection system according to claim 6, wherein if the difference between the lengths of the first and second toes of the customer is equal to or higher than a specified value, an oblique type shoe tip profile is selected.

10. The shoe shape selection system according to claim 6, further comprising wherein the plurality of data items include a customer having a preference of fit, wherein if the preference of fit is medium or slightly loose, the first toe height ratio of the customer is used as the plurality of data items, wherein the shoe shape selected has a larger shoe length size as the first toe height ratio of the customer increases.

* * * * *

UNITED STATES PATENT AND TRADEMARK OFFICE

CERTIFICATE OF CORRECTION

PATENT NO. : 7,613,588 B2
APPLICATION NO. : 10/552692
DATED : November 3, 2009
INVENTOR(S) : Katsu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 385 days.

Signed and Sealed this

Nineteenth Day of October, 2010

David J. Kappos

David J. Kappos
*Director of the United States Patent and Trademark Office*